US009570015B2

(12) United States Patent
Yang et al.

(10) Patent No.: US 9,570,015 B2
(45) Date of Patent: Feb. 14, 2017

(54) SIGNAL CONVERSION DEVICE, SIGNAL CONVERSION METHOD AND DISPLAY DEVICE

(71) Applicant: BOE TECHNOLOGY GROUP CO., LTD., Beijing (CN)

(72) Inventors: Fei Yang, Beijing (CN); Chen Zhang, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 198 days.

(21) Appl. No.: 14/422,819

(22) PCT Filed: May 22, 2014

(86) PCT No.: PCT/CN2014/078070
§ 371 (c)(1),
(2) Date: Feb. 20, 2015

(87) PCT Pub. No.: WO2015/096366
PCT Pub. Date: Jul. 2, 2015

(65) Prior Publication Data

US 2016/0042698 A1 Feb. 11, 2016

(30) Foreign Application Priority Data

Dec. 27, 2013 (CN) ..... 2013 1 0741315

(51) Int. Cl.
*G09G 3/34* (2006.01)
*G09G 3/20* (2006.01)
(Continued)

(52) U.S. Cl.
CPC ..... *G09G 3/3413* (2013.01); *G09G 3/2003* (2013.01); *G09G 3/2096* (2013.01);
(Continued)

(58) Field of Classification Search
CPC . G09G 2340/06; G09G 3/3648; G09G 3/2003
See application file for complete search history.

(56) References Cited

U.S. PATENT DOCUMENTS

2009/0102769 A1* 4/2009 Kouno ..... G09G 3/3648 345/88
2009/0160747 A1* 6/2009 Morisue ..... G09G 3/3406 345/88
(Continued)

FOREIGN PATENT DOCUMENTS

CN 1551707 A 12/2004
CN 101171594 A 4/2008
(Continued)

OTHER PUBLICATIONS

Office action issued in Chinese application No. 201310741315.7 dated Aug. 26, 2015.
(Continued)

*Primary Examiner* — Nalini Mummalaneni
*Assistant Examiner* — Sepehr Azari
(74) *Attorney, Agent, or Firm* — Nath, Goldberg & Meyer; Joshua B. Goldberg; Stanley N. Protigal

(57) ABSTRACT

The present invention discloses a signal conversion device, a signal conversion method and a display device. The signal conversion device includes a gamma conversion unit, a brightness detection unit and a brightness processing unit, wherein the gamma conversion unit is used for performing a gamma conversion process on RGB input signals and generating RGB brightness input values; the brightness detection unit is used for generating a W brightness input value based on RGB proportional coefficients and the RGB brightness input values; and the brightness processing unit is used for generating RGBW output signals based on the RGB proportional coefficients, the RGB brightness input values and the W brightness input value. With the present inven-
(Continued)

tion, the brightness of a displayed image can be increased without increasing the power consumption, so that the contrast of the displayed image is increased, and the display quality of the image is also improved.

22 Claims, 4 Drawing Sheets

(51) Int. Cl.

| | |
|---|---|
| ***G09G 5/04*** | (2006.01) |
| ***G09G 3/32*** | (2016.01) |
| *G09G 5/06* | (2006.01) |

(52) U.S. Cl.

CPC ..... *G09G 3/3208* (2013.01); *G09G 5/04* (2013.01); *G09G 5/06* (2013.01); *G09G 2300/0452* (2013.01); *G09G 2320/0238* (2013.01); *G09G 2320/0626* (2013.01); *G09G 2320/0673* (2013.01); *G09G 2330/021* (2013.01); *G09G 2330/023* (2013.01); *G09G 2340/06* (2013.01)

(56) References Cited

U.S. PATENT DOCUMENTS

| | | | | |
|---|---|---|---|---|
| 2009/0262148 | A1* | 10/2009 | Kimura ..... | G09G 3/2003 345/690 |
| 2012/0287146 | A1 | 11/2012 | Brown Elliott et al. | |
| 2013/0257924 | A1 | 10/2013 | Hirashima et al. | |
| 2015/0054864 | A1* | 2/2015 | Choi ..... | G09G 3/2003 345/694 |

FOREIGN PATENT DOCUMENTS

| | | | |
|---|---|---|---|
| CN | 101419771 | A | 4/2009 |
| CN | 103218988 | A | 7/2013 |
| CN | 103700336 | A | 4/2014 |

OTHER PUBLICATIONS

International Application No. PCT/CN2014/078070, International Search Report dated Sep. 26, 2014, twelve (12) pages.
3rd CN Office Action dated Sep. 23, 2016 for corresponding CN application 2013107413151.
Extended European Search Report 148611395 dated Sep. 12, 2016, for corresponding EP application.

* cited by examiner

SIGNAL CONVERSION DEVICE, SIGNAL CONVERSION METHOD AND DISPLAY DEVICE

This is a National Phase Application filed under 35 U.S.C. 371 as a national stage of PCT/CN2014/078070, filed May 22, 2014, and claims priority benefit from Chinese Application No. 201310741315.7, filed Dec. 27, 2013, the content of each of which is hereby incorporated by reference in its entirety.

FIELD OF THE INVENTION

The present invention relates to the field of display technology, and particularly relates to a signal conversion device, a signal conversion method and a display device.

BACKGROUND OF THE INVENTION

At present, customers not only have strict requirements on the appearance and quality of products, but also concern the price and usability of products. In the field of display technology, especially in the field of OLED (Organic Light-Emitting Diode) display technology, low luminous efficiencies of red, green and blue colors have become the bottleneck of optimizing products. To fulfill customer's requirements, a new technology of arranging pixels comprising red sub-pixels (R), green sub-pixels (G), blue sub-pixels (B) and white sub-pixels (W) (that is, RGBW arrangement) has been developed. However, signal transmission interfaces such as VGA (Video Graphics Array) and DVI (Digital Visual Interface) generally transmit RGB signals. For this reason, during an image displaying process, the transmitted RGB signals need to be converted into RGBW signals for displaying by the display device in a case where the image is not distorted.

However, methods of converting RGB signals to RGBW signals in the prior art have the following problems:

(1) The brightness and contrast of displayed image are reduced, so that the display quality of the displayed image is lowered;

(2) The power consumption of light emitting devices is relatively large during the displaying process of the displayed image, so that the lifetime of the light emitting devices is reduced; and (3) The power consumption of light emitting devices is relatively large during the displaying process of the displayed image, and thus a driving chip with relatively high cost is required, so that the manufacturing cost of products is increased.

SUMMARY OF THE INVENTION

The present invention provides a signal conversion device, a signal conversion method and a display device for increasing the brightness of a displayed image without changing power consumption and for decreasing power consumption of light emitting devices without changing display brightness of the displayed image.

To achieve the above objective, the present invention provides a signal conversion device including a gamma conversion unit, a brightness detection unit and a brightness processing unit, wherein the gamma conversion unit is used for performing a gamma conversion process on RGB input signals and generating RGB brightness input values;

the brightness detection unit is used for generating a W brightness input value based on RGB proportional coefficients and the RGB brightness input values; and the brightness processing unit is used for generating RGBW output signals based on the RGB proportional coefficients, the RGB brightness input values and the W brightness input value.

Optionally, the brightness processing unit includes a brightness calculation unit and a reverse gamma conversion unit, wherein the brightness calculation unit generates RGBW brightness output values based on the RGB proportional coefficients, the RGB brightness input values and the W brightness input value, and outputs the RGBW brightness output values to the reverse gamma conversion unit; and the reverse gamma conversion unit generates the RGBW output signals based on the RGBW brightness output values.

Optionally, the brightness processing unit further includes a brightness scaling unit for performing a scaling process on maximum RGBW brightness values based on brightness scaling coefficients, generating the scaled maximum RGBW brightness values, and outputting the scaled maximum RGBW brightness values to the gamma conversion unit and the reverse gamma conversion unit, wherein the gamma conversion unit performs the gamma conversion process on the RGB input signals based on the scaled maximum RGBW brightness values, generates the RGB brightness input values, and outputs the RGB brightness input values to the brightness detection unit and the brightness calculation unit; and the reverse gamma conversion unit generates the RGBW output signals based on the scaled maximum RGBW brightness values and the RGBW brightness output values.

Optionally, the brightness processing unit includes a brightness calculation unit, a brightness scaling unit and a reverse gamma conversion unit, wherein the gamma conversion unit performs the gamma conversion process on the RGB input signals based on the maximum RGBW brightness values, generates RGB brightness input values, and outputs the RGB brightness input values to the brightness detection unit and the brightness calculation unit;

the brightness calculation unit generates the RGBW brightness output values based on the RGB proportional coefficients, the RGB brightness input values and the W brightness input value, and outputs the RGBW brightness output values to the brightness scaling unit;

the brightness scaling unit performs a scaling process on the RGBW brightness output values based on brightness scaling coefficients, generates scaled RGBW brightness output values, and outputs the scaled RGBW brightness output values to the reverse gamma conversion unit, and the reverse gamma conversion unit generates the RGBW output signals based on the maximum RGBW brightness values and the scaled RGBW brightness output values.

Optionally, the scaled maximum RGBW brightness values include a scaled maximum R brightness value $L_{R\ max}$, a scaled maximum G brightness value $L_{G\ max}$, a scaled maximum B brightness value $L_{B\ max}$, and a scaled maximum W brightness value $L_{W\ max}$; the RGB input signals include a R input signal Ri, a G input signal Gi and a B input signal Bi; the RGB brightness input values include a R brightness input value $L_R$, a G brightness input value $L_G$ and a B brightness input value $L_B$; and equations for the RGBW brightness input values are:

$$L_R = L_{Rmax} \times \left(\frac{Ri}{2^n}\right)^{\gamma},$$

$$L_G = L_{Gmax} \times \left(\frac{Gi}{2^n}\right)^{\gamma} \text{ and } L_B = L_{Bmax} \times \left(\frac{Bi}{2^n}\right)^{\gamma},$$

where n is the number of bits of the RGB input signals and γ is a gamma value.

Optionally, the RGBW brightness output values include a R brightness output value $L_{R'}$, a G brightness output value $L_{G'}$, a B brightness output value $L_{B'}$, and a W brightness output value $L_{W'}$, the RGB proportional coefficients include a R proportional coefficient $R_R$, a G proportional coefficient $R_G$ and a B proportional coefficient $R_B$ the RGBW brightness output values are $L_{R'}=L_R-L_W\times R_R$, $L_{G'}=L_G-L_W\times R_G$, $L_{B'}=L_B-L_W\times R_B$, $L_{W'}=L_W$, respectively, where $L_W$ is the W brightness input value.

Optionally, the RGBW output signals include a R output signal Ro, a G output signal Go, a B output signal Bo and a W output signal Wo;

the RGBW output signals are $$Ro = \left(\frac{L_{R'}}{L_{Rmax}}\right)^{\frac{1}{\gamma}} \times 2^n,\ Go = \left(\frac{L_{G'}}{L_{Gmax}}\right)^{\frac{1}{\gamma}} \times 2^n,$$

$$Bo = \left(\frac{L_{B'}}{L_{Bmax}}\right)^{\frac{1}{\gamma}} \times 2^n \text{ and } Wo = \left(\frac{L_{W'}}{L_{Wmax}}\right)^{\frac{1}{\gamma}} \times 2^n,$$

respectively.

Optionally, the brightness scaling coefficient of the brightness scaling unit is K, the maximum R brightness value is $L_{R'\,max}$, the maximum G brightness value is $L_{G'\,max}$, the maximum B brightness value is $L_{B'\,max}$ and the maximum W brightness value is $L_{W'\,max}$, wherein $L_{R\,max}=K\times L_{R'\,max}$, $L_{G\,max}=K\times L_{G'\,max}$, $L_{B\,max}=K\times L_{B'\,max}$ and $L_{W\,max}=K\times L_{W'\,max}$, so that $$Ro = \left(\frac{L_{R'}}{K \times L_{R'max}}\right)^{\frac{1}{\gamma}} \times 2^n,\ Go = \left(\frac{L_{G'}}{K \times L_{G'max}}\right)^{\frac{1}{\gamma}} \times 2^n,$$

$$Bo = \left(\frac{L_{B'}}{K \times L_{B'max}}\right)^{\frac{1}{\gamma}} \times 2^n \text{ and } Wo = \left(\frac{L_{W'}}{K \times L_{W'max}}\right)^{\frac{1}{\gamma}} \times 2^n.$$

In addition, optionally, the RGB input signals include a R input signal Ri, a G input signal Gi and a B input signal Bi, and the RGB brightness input values include a R brightness input value $L_R$, a G brightness input value $L_G$ and a B brightness input value $L_B$; equations for the RGB brightness input values are $$L_R = L_{R'max} \times \left(\frac{Ri}{2^n}\right)^{\gamma},$$

$$L_G = L_{G'max} \times \left(\frac{Gi}{2^n}\right)^{\gamma} \text{ and } L_B = L_{B'max} \times \left(\frac{Bi}{2^n}\right)^{\gamma},$$

where n is the number of bits of the RGB input signals, γ is a gamma value, $L_{R'\,max}$ is the maximum R brightness value, $L_{G'\,max}$ is the maximum G brightness value and $L_{B'\,max}$ is the maximum B brightness value.

Optionally, the RGBW brightness output values include a R brightness output value $L_{R'}$, a G brightness output value $L_{G'}$, a B brightness output value $L_{B'}$, and a W brightness output value $L_{W'}$, the RGB proportional coefficients include a R proportional coefficient $R_R$, a G proportional coefficient $R_G$ and a B proportional coefficient $R_B$ the RGBW brightness output values are $L_{R'}=L_R-L_W\times R_R$, $L_{G'}=L_G-L_W\times R_G$, $L_{B'}=L_B-L_W\times R_B$, $L_{W'}=L_W$, respectively, wherein $L_W$ is the W brightness input value.

Optionally, the RGBW output signals include a R output signal Ro, a G output signal Go, a B output signal Bo and a W output signal Wo;

the RGBW output signals are $$Ro = \left(\frac{L_{R1}}{L_{R'max}}\right)^{\frac{1}{\gamma}} \times 2^n,\ Go = \left(\frac{L_{G1}}{L_{G'max}}\right)^{\frac{1}{\gamma}} \times 2^n,$$

$$Bo = \left(\frac{L_{B1}}{L_{B'max}}\right)^{\frac{1}{\gamma}} \times 2^n \text{ and } Wo = \left(\frac{L_{W1}}{L_{W'max}}\right)^{\frac{1}{\gamma}} \times 2^n,$$

respectively, where $L_{W'\,max}$ is the maximum W brightness value, $L_{R1}$ is a scaled R brightness output value, $L_{G1}$ is a scaled G brightness output value, $L_{B1}$ is a scaled B brightness output value and $L_{W1}$ is a scaled W brightness output value.

Optionally, the brightness scaling coefficient of the brightness scaling unit is 1/K, and $$L_{R1} = \frac{L_{R'}}{K},\ L_{G1} = \frac{L_{G'}}{K},\ L_{B1} = \frac{L_{B'}}{K} \text{ and } L_{W1} = \frac{L_{W'}}{K},$$

the RGBW output signals are $$Ro = \left(\frac{L_{R'}}{K \times L_{R'max}}\right)^{\frac{1}{\gamma}} \times 2^n,\ Go = \left(\frac{L_{G'}}{K \times L_{G'max}}\right)^{\frac{1}{\gamma}} \times 2^n,$$

$$Bo = \left(\frac{L_{B'}}{K \times L_{B'max}}\right)^{\frac{1}{\gamma}} \times 2^n \text{ and } Wo = \left(\frac{L_{W'}}{K \times L_{W'max}}\right)^{\frac{1}{\gamma}} \times 2^n,$$

respectively.

Optionally, the signal conversion device further includes a RGB proportion calculation unit, wherein the RGB proportion calculation unit is used for calculating the RGB proportional coefficients based on color coordinates for RGBW.

Optionally, the color coordinates for RGBW include a R color coordinate $R(x_R, y_R)$, a G color coordinate $G(x_G, y_G)$, a B color coordinate $B(x_B, y_B)$ and a W color coordinate $W(x_W, y_W)$.

Equation for the RGB proportional coefficients is proportional coefficient for red $$R_R = \frac{\left(\frac{x_W}{y_W} - \frac{x_B}{y_B}\right)\times\left(\frac{1}{y_G} - \frac{1}{y_B}\right) - \left(\frac{x_G}{y_G} - \frac{x_B}{y_B}\right)\times\left(\frac{1}{y_W} - \frac{1}{y_B}\right)}{\left(\frac{x_R}{y_R} - \frac{x_B}{y_B}\right)\times\left(\frac{1}{y_G} - \frac{1}{y_B}\right) - \left(\frac{x_G}{y_G} - \frac{x_B}{y_B}\right)\times\left(\frac{1}{y_R} - \frac{1}{y_B}\right)},$$

proportional coefficient for green $$R_G = \frac{\left(\frac{x_W}{y_W} - \frac{x_R}{y_R}\right)\times\left(\frac{1}{y_B} - \frac{1}{y_R}\right) - \left(\frac{x_B}{y_B} - \frac{x_R}{y_R}\right)\times\left(\frac{1}{y_W} - \frac{1}{y_R}\right)}{\left(\frac{x_G}{y_G} - \frac{x_R}{y_R}\right)\times\left(\frac{1}{y_B} - \frac{1}{y_R}\right) - \left(\frac{x_B}{y_B} - \frac{x_R}{y_R}\right)\times\left(\frac{1}{y_G} - \frac{1}{y_R}\right)},$$

and proportional coefficient for blue $$R_B = \frac{\left(\frac{x_W}{y_W} - \frac{x_G}{y_G}\right)\times\left(\frac{1}{y_R} - \frac{1}{y_G}\right) - \left(\frac{x_R}{y_R} - \frac{x_G}{y_R}\right)\times\left(\frac{1}{y_W} - \frac{1}{y_G}\right)}{\left(\frac{x_B}{y_B} - \frac{x_G}{y_G}\right)\times\left(\frac{1}{y_R} - \frac{1}{y_G}\right) - \left(\frac{x_R}{y_R} - \frac{x_G}{y_G}\right)\times\left(\frac{1}{y_B} - \frac{1}{y_G}\right)};$$

or proportional coefficient for red $$R_R = \frac{\left(\frac{x_W}{y_W} - \frac{x_G}{y_G}\right)\times\left(\frac{1}{y_B} - \frac{1}{y_G}\right) - \left(\frac{x_B}{y_B} - \frac{x_G}{y_G}\right)\times\left(\frac{1}{y_W} - \frac{1}{y_G}\right)}{\left(\frac{x_R}{y_R} - \frac{x_G}{y_G}\right)\times\left(\frac{1}{y_B} - \frac{1}{y_G}\right) - \left(\frac{x_B}{y_B} - \frac{x_G}{y_G}\right)\times\left(\frac{1}{y_R} - \frac{1}{y_G}\right)},$$

proportional coefficient for green $$R_G = \frac{\left(\frac{x_W}{y_W} - \frac{x_B}{y_B}\right)\times\left(\frac{1}{y_R} - \frac{1}{y_B}\right) - \left(\frac{x_R}{y_R} - \frac{x_B}{y_B}\right)\times\left(\frac{1}{y_W} - \frac{1}{y_B}\right)}{\left(\frac{x_G}{y_G} - \frac{x_B}{y_B}\right)\times\left(\frac{1}{y_R} - \frac{1}{y_B}\right) - \left(\frac{x_R}{y_R} - \frac{x_B}{y_B}\right)\times\left(\frac{1}{y_G} - \frac{1}{y_B}\right)},$$

and proportional coefficient for blue $$R_B = \frac{\left(\frac{x_W}{y_W} - \frac{x_R}{y_R}\right)\times\left(\frac{1}{y_G} - \frac{1}{y_R}\right) - \left(\frac{x_G}{y_G} - \frac{x_R}{y_R}\right)\times\left(\frac{1}{y_W} - \frac{1}{y_R}\right)}{\left(\frac{x_B}{y_B} - \frac{x_R}{y_R}\right)\times\left(\frac{1}{y_G} - \frac{1}{y_R}\right) - \left(\frac{x_G}{y_G} - \frac{x_R}{y_R}\right)\times\left(\frac{1}{y_B} - \frac{1}{y_R}\right)}.$$

Optionally, the brightness detection unit generates RGB brightness substitute values based on the RGB proportional coefficients and the RGB brightness input values, and selects a minimum value from the RGB brightness substitute values as the W brightness input value.

Optionally, the RGB brightness substitute values include a R brightness substitute value $S_R$, a G brightness substitute value $S_G$ and a B brightness substitute value $S_B$, and the RGB brightness substitute values are $$S_R = \frac{L_R}{R_R},\ S_G = \frac{L_G}{R_G} \text{ and } S_B = \frac{L_B}{R_B},$$

respectively; in this case, equation for the W brightness input value is $L_W$=MIN ($S_R$, $S_G$, $S_B$).

To achieve the above objective, the present invention provides a display device, including the above-described signal conversion device.

To achieve the above objective, the present invention provides a signal conversion method, including the following steps of S1 to S3.

Step S1, generating RGB brightness input values by performing a gamma conversion process on RGB input signals;

Step S2, generating a W brightness input value based on RGB proportional coefficients and the RGB brightness input values; and Step S3, generating RGBW output signals based on the RGB proportional coefficients, the RGB brightness input values and the W brightness input value.

Optionally, the step S3 includes a step of generating RGBW brightness output values based on the RGB proportional coefficients, the RGB brightness input values and the W brightness input value, and a step of generating the RGBW output signals based on the RGBW brightness output values.

Optionally, the step S1 further includes a step of generating scaled maximum RGBW brightness values by performing a scaling process on maximum RGBW brightness values based on brightness scaling coefficients and a step of generating RGB brightness input values by performing a gamma conversion process on the RGB input signals based the scaled maximum RGBW brightness values, and the step S3 further includes a step of generating the RGBW output signals based on the scaled maximum RGBW brightness values and the RGBW brightness output values.

Optionally, the step S1 further includes a step of generating the RGB brightness input values by performing a gamma conversion process on the RGB input signals based on the maximum RGBW brightness values, and the step S3 further includes a step of generating scaled RGBW brightness output values by performing a scaling process on the RGBW brightness output values based on the brightness scaling coefficients and a step of generating the RGBW output signals based on the maximum RGBW brightness values and the scaled RGBW brightness output values.

Optionally, the signal conversion method further includes a step of calculating the RGB proportional coefficients based on color coordinates for RGBW.

Optionally, the step S2 further includes a step of generating RGB brightness substitute values based on the RGB proportional coefficients and the RGB brightness input values and obtaining the W brightness input value by selecting a minimum value from the RGB brightness substitute values.

The present invention has the following beneficial effects:

In the technical solutions of the signal conversion device, the signal conversion method and the display device provided by the present invention, the gamma conversion unit is used for performing a gamma conversion process on RGB input signals and generating RGB brightness input values, the brightness detection unit is used for generating a W brightness input value based on RGB proportional coefficients and the RGB brightness input values and the brightness processing unit is used for generating RGBW output signals based on the RGB proportional coefficients, the RGB brightness input values and the W brightness input value. With the present invention, the brightness of a displayed image can be increased with a premise that the power consumption is not changed, so that the contrast of the displayed image is increased, and the display quality of the image is also improved. With the present invention, the power consumption of light emitting devices is reduced with a premise that the display brightness of a displayed image is not changed, so that the lifetime of the light emitting devices is increased, the cost of driving chips is reduced and thus the manufacturing cost of products is reduced.

DETAILED DESCRIPTION OF THE EMBODIMENTS

To make those skilled in the art better understand the technical solutions of the present invention, the signal conversion device, the signal conversion method and the display device provided by the present invention will be described below in details in conjunction with the accompanying drawings.

Figure 1:
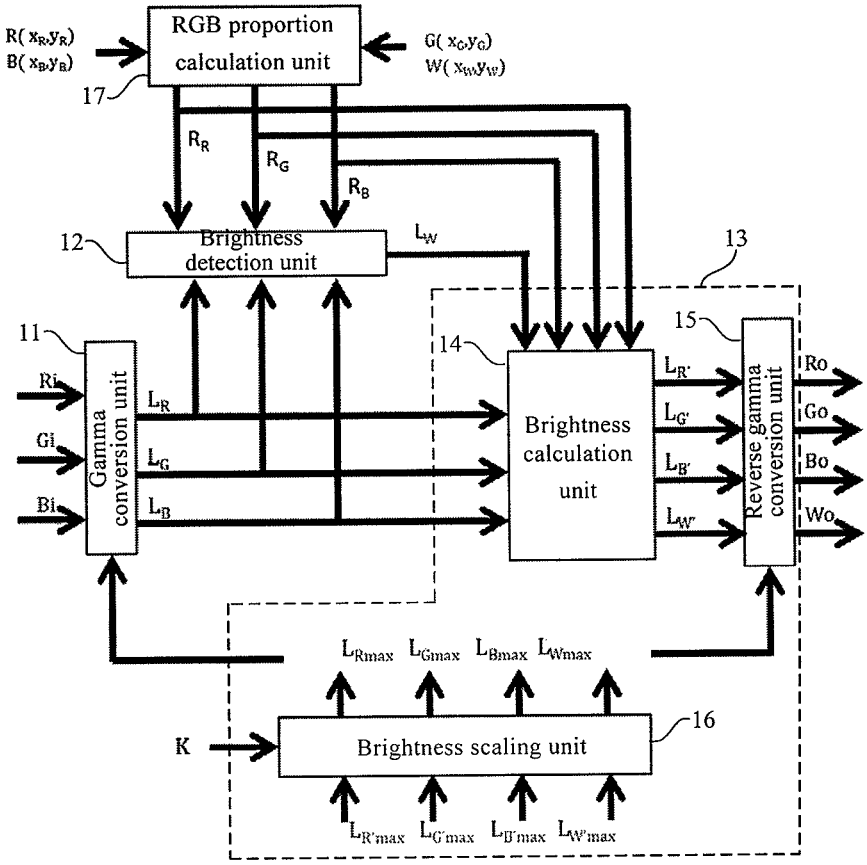
FIG. 1 is a schematic diagram of a structure of a signal conversion device provided by Embodiment 1 of the present invention.

FIG. 1 is a schematic diagram of a structure of a signal conversion device provided by Embodiment 1 of the present invention. As shown in FIG. 1, the device includes a gamma conversion unit 11, a brightness detection unit 12 and a brightness processing unit 13. The gamma conversion unit 11 is used for generating RGB brightness input values by performing a gamma conversion process on RGB input signals. The brightness detection unit 12 is used for generating a W brightness input value based on RGB proportional coefficients and the RGB brightness input values. The brightness processing unit 13 is used for generating RGBW output signals based on the RGB proportional coefficients, the RGB brightness input values and the W brightness input value. In this specification, R represents red, G represents green, B represents blue and W represents white.

In this embodiment, the brightness processing unit 13 includes a brightness calculation unit 14 and a reverse gamma conversion unit 15. The brightness calculation unit 14 is used for generating RGBW brightness output values based on the RGB proportional coefficients, the RGB brightness input values and the W brightness input value, and outputs the RGBW brightness output values to the reverse gamma conversion unit 15. The reverse gamma conversion unit 15 is used for generating RGBW output signals based on the RGBW brightness output values.

Further, the brightness processing unit 13 also includes a brightness scaling unit 16. The brightness scaling unit 16 is used for performing a scaling process on maximum RGBW brightness values based on brightness scaling coefficients, generating scaled maximum RGBW brightness values, and outputting the scaled maximum RGBW brightness values to the gamma conversion unit 11 and the reverse gamma conversion unit 15. Specifically, the maximum RGBW brightness values include a maximum R brightness value $L_{R' max}$, a maximum G brightness value $L_{G' max}$, a maximum B brightness value $L_{B' max}$ and a maximum W brightness value $L_{W' max}$, and the scaled maximum RGBW brightness values include a scaled maximum R brightness value $L_{R max}$, a scaled maximum G brightness value $L_{G max}$, scaled maximum B brightness value $L_{B max}$ and a scaled maximum W brightness value $L_{W max}$. The brightness scaling coefficient is K which is ranged from 0.5 to 2, and equations for the scaled maximum RGBW brightness values are $L_{R max}=K\times L_{R' max}$, $L_{G max}=K\times L_{G' max}$, $L_{B max}=K\times L_{B' max}$ and $L_{W max}=K\times L_{W' max}$.

The gamma conversion unit 11 is specifically used for performing a gamma conversion process on the RGB input signals based on the scaled maximum RGBW brightness values, generating the RGB brightness input values, and outputting the RGB brightness input values to the brightness detection unit 12 and the brightness calculation unit 14. Specifically, the RGB input signals include a R input signal Ri, a G input signal Gi and a B input signal Bi, and the RGB brightness input values include a R brightness input value $L_R$, a G brightness input value $L_G$ and a B brightness input value $L_B$, so that equations for the RGBW brightness input values are:

$$L_R = L_{Rmax}\times\left(\frac{Ri}{2^n}\right)^{\gamma},\ L_G = L_{Gmax}\times\left(\frac{Gi}{2^n}\right)^{\gamma}\ \text{and}\ L_B = L_{Bmax}\times\left(\frac{Bi}{2^n}\right)^{\gamma},$$

where n is the number of bits of RGB input signals and γ is a gamma value and may be ranged from 2.0 to 2.4. In this embodiment, taking that n=8 and γ=2.2 as an example, then the equations for RGB brightness input values may be $$L_R = L_{Rmax}\times\left(\frac{Ri}{255}\right)^{2.2},\ L_G = L_{Gmax}\times\left(\frac{Gi}{255}\right)^{2.2}\ \text{and}$$

$$L_B = L_{Bmax}\times\left(\frac{Bi}{255}\right)^{2.2}.$$

In this embodiment, the brightness detection unit 12 is specifically used for generating RGB brightness substitute values based on the RGB proportional coefficients and the RGB brightness input values, obtaining the W brightness input value by selecting a minimum value from the RGB brightness substitute values, and outputting the W brightness input value to the brightness calculation unit 14. Specifically, the RGB proportional coefficients include a R proportional coefficient $R_R$, a G proportional coefficient $R_G$ and a B proportional coefficient $R_B$, the RGB brightness substitute values include a R brightness substitute value $S_R$, a G brightness substitute value $S_G$ and a B brightness substitute value $S_B$, and the W brightness input value is $L_W$. In this case, the RGB brightness substitute values are $$S_R = \frac{L_R}{R_R},\ S_G = \frac{L_G}{R_G}\ \text{and}\ S_B = \frac{L_B}{R_B},$$

respectively, and equation for the W brightness input value is $L_W=\mathrm{MIN}(S_R, S_G, S_B)$.

Optionally, the signal conversion device further includes a RGB proportion calculation unit 17, wherein the RGB proportion calculation unit 17 is used for calculating the RGB proportional coefficients based on color coordinates for RGBW, and outputting the RGB proportional coefficients to the brightness detection unit 12 and the brightness calculation unit 14. Specifically, the color coordinates for RGBW include a R color coordinate $R(x_R, y_R)$, a G color coordinate $G(x_G, y_G)$, a B color coordinate $B(x_B, y_B)$ and a W color coordinate $W(x_W, y_W)$. In this case, Equation (1) for the RGB proportional coefficients may be:

proportional coefficient for red $$R_R = \frac{\left(\frac{x_W}{y_W} - \frac{x_B}{y_B}\right)\times\left(\frac{1}{y_G} - \frac{1}{y_B}\right) - \left(\frac{x_G}{y_G} - \frac{x_B}{y_B}\right)\times\left(\frac{1}{y_W} - \frac{1}{y_B}\right)}{\left(\frac{x_R}{y_R} - \frac{x_B}{y_B}\right)\times\left(\frac{1}{y_G} - \frac{1}{y_B}\right) - \left(\frac{x_G}{y_G} - \frac{x_B}{y_B}\right)\times\left(\frac{1}{y_R} - \frac{1}{y_B}\right)},$$

proportional coefficient for green $$R_G = \frac{\left(\frac{x_W}{y_W} - \frac{x_R}{y_R}\right)\times\left(\frac{1}{y_B} - \frac{1}{y_R}\right) - \left(\frac{x_B}{y_B} - \frac{x_R}{y_R}\right)\times\left(\frac{1}{y_W} - \frac{1}{y_R}\right)}{\left(\frac{x_G}{y_G} - \frac{x_R}{y_R}\right)\times\left(\frac{1}{y_B} - \frac{1}{y_R}\right) - \left(\frac{x_B}{y_B} - \frac{x_R}{y_R}\right)\times\left(\frac{1}{y_G} - \frac{1}{y_R}\right)},$$

and proportional coefficient for blue $$R_B = \frac{\left(\frac{x_W}{y_W} - \frac{x_G}{y_G}\right)\times\left(\frac{1}{y_R} - \frac{1}{y_G}\right) - \left(\frac{x_R}{y_R} - \frac{x_G}{y_G}\right)\times\left(\frac{1}{y_W} - \frac{1}{y_G}\right)}{\left(\frac{x_B}{y_B} - \frac{x_G}{y_G}\right)\times\left(\frac{1}{y_R} - \frac{1}{y_G}\right) - \left(\frac{x_R}{y_R} - \frac{x_G}{y_G}\right)\times\left(\frac{1}{y_B} - \frac{1}{y_G}\right)}.$$

In practical applications, other equations can be used for calculating the RGB proportional coefficients, for example, equation (2) for the RGB proportional coefficients may be:

proportional coefficient for red $$R_R = \frac{\left(\frac{x_W}{y_W} - \frac{x_G}{y_G}\right)\times\left(\frac{1}{y_B} - \frac{1}{y_G}\right) - \left(\frac{x_B}{y_B} - \frac{x_G}{y_G}\right)\times\left(\frac{1}{y_W} - \frac{1}{y_G}\right)}{\left(\frac{x_R}{y_R} - \frac{x_G}{y_G}\right)\times\left(\frac{1}{y_B} - \frac{1}{y_G}\right) - \left(\frac{x_B}{y_B} - \frac{x_G}{y_G}\right)\times\left(\frac{1}{y_R} - \frac{1}{y_G}\right)},$$

proportional coefficient for green $$R_G = \frac{\left(\frac{x_W}{y_W} - \frac{x_B}{y_B}\right)\times\left(\frac{1}{y_R} - \frac{1}{y_B}\right) - \left(\frac{x_R}{y_R} - \frac{x_B}{y_B}\right)\times\left(\frac{1}{y_W} - \frac{1}{y_B}\right)}{\left(\frac{x_G}{y_G} - \frac{x_B}{y_B}\right)\times\left(\frac{1}{y_R} - \frac{1}{y_B}\right) - \left(\frac{x_R}{y_R} - \frac{x_B}{y_B}\right)\times\left(\frac{1}{y_G} - \frac{1}{y_B}\right)},$$

and proportional coefficient for blue $$R_B = \frac{\left(\frac{x_W}{y_W} - \frac{x_R}{y_R}\right)\times\left(\frac{1}{y_G} - \frac{1}{y_R}\right) - \left(\frac{x_G}{y_G} - \frac{x_R}{y_R}\right)\times\left(\frac{1}{y_W} - \frac{1}{y_R}\right)}{\left(\frac{x_B}{y_B} - \frac{x_R}{y_R}\right)\times\left(\frac{1}{y_G} - \frac{1}{y_R}\right) - \left(\frac{x_G}{y_G} - \frac{x_R}{y_R}\right)\times\left(\frac{1}{y_B} - \frac{1}{y_R}\right)}.$$

The calculation results from the above equation (1) and (2) for the RGB proportional coefficients are the same.

In this embodiment, the RGBW brightness output values include a R brightness output value $L_{R'}$, a G brightness output value $L_{G'}$, a B brightness output value $L_{B'}$, and a W brightness output value $L_{W'}$, then the equations for the RGBW brightness output values generated by the brightness calculation unit 14 are $L_{R'}=L_R-L_W\times R_R$, $L_{G'}=L_G-L_W\times R_G$, $L_{B'}=L_B-L_W\times R_B$, $L_{W'}=L_W$.

In this embodiment, the reverse gamma conversion unit 15 is specifically used for generating the RGBW output signals based on the scaled maximum RGBW brightness values and the RGBW brightness output values. Specifically, the RGBW output signals include a R output signal Ro, a G output signal Go, a B output signal Bo and a W output signal Wo, then the equations for RGBW output signals are $$Ro = \left(\frac{L_{R'}}{L_{Rmax}}\right)^{\frac{1}{\gamma}} \times 2^n,\ Go = \left(\frac{L_{G'}}{L_{Gmax}}\right)^{\frac{1}{\gamma}} \times 2^n,\ Bo = \left(\frac{L_{B'}}{L_{Bmax}}\right)^{\frac{1}{\gamma}} \times 2^n \text{ and}$$

$$Wo = \left(\frac{L_{W'}}{L_{Wmax}}\right)^{\frac{1}{\gamma}} \times 2^n.$$

Since this embodiment is described by taking that n=8 and γ=2.2 as an example, the equations for RGBW output signals may be $$Ro = \left(\frac{L_{R'}}{L_{Rmax}}\right)^{\frac{1}{2.2}} \times 255,\ Go = \left(\frac{L_{G'}}{L_{Gmax}}\right)^{\frac{1}{2.2}} \times 255,\ Bo = \left(\frac{L_{B'}}{L_{Bmax}}\right)^{\frac{1}{2.2}} \times 255,$$

$$Wo = \left(\frac{L_{W'}}{L_{Wmax}}\right)^{\frac{1}{2.2}} \times 255,$$

while the equations for RGBW output signals may also represent as $$Ro = \left(\frac{L_{R'}}{K \times L_{R'max}}\right)^{\frac{1}{\gamma}} \times 2^n,\ Go = \left(\frac{L_{G'}}{K \times L_{G'max}}\right)^{\frac{1}{\gamma}} \times 2^n,$$

$$Bo = \left(\frac{L_{B'}}{K \times L_{B'max}}\right)^{\frac{1}{\gamma}} \times 2^n \text{ and } Wo = \left(\frac{L_{W'}}{K \times L_{W'max}}\right)^{\frac{1}{\gamma}} \times 2^n.$$

In the signal conversion device provided by the present embodiment, the gamma conversion unit is used for performing a gamma conversion process on RGB input signals and generating RGB brightness input values, the brightness detection unit is used for generating a W brightness input value based on RGB proportional coefficients and the RGB brightness input values, and the brightness processing unit is used for generating RGBW output signals based on the RGB proportional coefficients, the RGB brightness input values and the W brightness input value. With the present embodiment, the brightness of a displayed image can be increased with a premise that the power consumption is not changed, so that the contrast of the displayed image is increased, and the display quality of the image is also improved. With the present embodiment, the power consumption of light emitting devices is reduced with a premise that the display brightness of a displayed image is not changed, so that the lifetime of the light emitting devices is increased, the cost of driving chips is reduced and thus the manufacturing cost of products is reduced. Furthermore, with the present embodiment, the manufacturing cost of power supply can be reduced since the power consumption of light emitting devices is reduced, and thus the manufacturing cost of products is reduced. In addition, the brightness scaling unit can generate scaled maximum RGBW brightness values by performing the scaling process on the maximum RGBW brightness values based on the brightness scaling coefficients, so that the brightness of the displayed image can be further improved.

Figure 2:
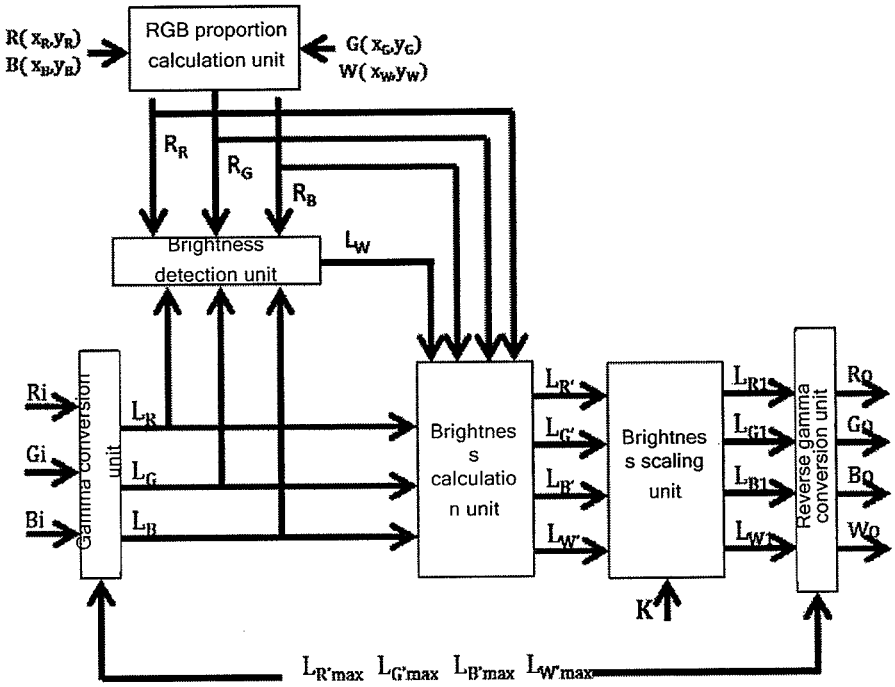
FIG. 2 is a schematic diagram of a structure of a signal conversion device provided by Embodiment 2 of the present invention.

FIG. 2 is a schematic diagram of a structure of a signal conversion device provided by Embodiment 2 of the present invention. As shown in FIG. 2, the difference between the signal conversion device provided by this embodiment and that provided by Embodiment 1 is a brightness processing unit 21 including a brightness calculation unit 14, a brightness scaling unit 22 and a reverse gamma conversion unit 23.

In this embodiment, detailed descriptions of the gamma conversion unit 11, the brightness detection unit 12, the brightness calculation unit 14 and the RGB proportion calculation unit 17 can refer to those of the Embodiment 1, and will not be redundantly described here.

In this embodiment, the brightness calculation unit 14 outputs RGBW brightness output values to the brightness scaling unit 22. The brightness scaling unit 22 is used for performing a scaling process on the RGBW brightness output values based on brightness scaling coefficients, generating scaled RGBW brightness output values, and outputting the scaled RGBW brightness output values to the reverse gamma conversion unit 23. Specifically, the scaled RGBW brightness output values include a scaled R brightness output value $L_{R1}$, a scaled G brightness output value $L_{G1}$, a scaled B brightness output value $L_{B1}$ and a scaled W brightness output value $L_{W1}$. Assuming that the brightness scaling coefficient of the brightness scaling unit 22 is 1/K, then the equations for the scaled RGBW brightness output values are $$L_{R1} = \frac{L_{R'}}{K},\ L_{G1} = \frac{L_{G'}}{K},\ L_{B1} = \frac{L_{B'}}{K} \text{ and } L_{W1} = \frac{L_{W'}}{K}.$$

The reverse gamma conversion unit 23 is used for generating RGBW output signals based on the maximum RGBW brightness values $L_{R'\,max}$, $L_{G'\,max}$, $L_{B'\,max}$, $L_{W'\,max}$ and the scaled RGBW brightness output values. The equations for the RGBW output signals are $$Ro = \left(\frac{L_{R1}}{L_{R'max}}\right)^{\frac{1}{\gamma}} \times Go = \left(\frac{L_{G1}}{L_{G'max}}\right)^{\frac{1}{\gamma}} \times 2^n,\ Bo = \left(\frac{L_{B1}}{L_{B'max}}\right)^{\frac{1}{\gamma}} \times 2^n \text{ and}$$

$$Wo = \left(\frac{L_{W1}}{L_{W'max}}\right)^{\frac{1}{\gamma}} \times 2^n.$$

Since this embodiment is taking that n=8 and γ=2.2 as an example, the equations for the RGBW output signals may be $$Ro = \left(\frac{L_{R'}}{K \times L_{R'max}}\right)^{\frac{1}{\gamma}} \times 2^n,\ Go = \left(\frac{L_{G'}}{K \times L_{G'max}}\right)^{\frac{1}{\gamma}} \times 2^n,$$

$$Bo = \left(\frac{L_{B'}}{K \times L_{B'max}}\right)^{\frac{1}{\gamma}} \times 2^n \text{ and } Wo = \left(\frac{L_{W'}}{K \times L_{W'max}}\right)^{\frac{1}{\gamma}} \times 2^n.$$

The calculation results from the equations for the RGBW output signals in this embodiment are the same as the calculation results from the equations for the RGBW output signals in Embodiment 1 described above.

In the signal conversion device provided by the present embodiment, the gamma conversion unit is used for performing a gamma conversion process on RGB input signals and generating RGB brightness input values, the brightness detection unit is used for generating a W brightness input value based on RGB proportional coefficients and the RGB brightness input values, and the brightness processing unit is used for generating RGBW output signals based on the RGB proportional coefficients, the RGB brightness input values and the W brightness input value. With the present embodiment, the brightness of a displayed image can be increased with a premise that the power consumption is not changed, so that the contrast of the displayed image is increased, and the display quality of the image is also improved. With the present embodiment, the power consumption of light emitting devices is reduced with a premise that the display brightness of a displayed image is not changed, so that the lifetime of the light emitting devices is increased, the cost of driving chips is reduced and thus the manufacturing cost of products is reduced. Furthermore, with the present embodiment, the manufacturing cost of power supply can be reduced since the power consumption of light emitting devices is reduced, and thus the manufacturing cost of products is reduced. In addition, the brightness scaling unit can generate scaled RGBW brightness output values by performing the scaling process on the RGBW brightness output values based on the brightness scaling coefficients, so that the brightness of the displayed image can be further improved.

Embodiment 3 of the present invention provides a display device including a signal conversion device. In this embodiment, the signal conversion device may adopt the signal conversion device provided by Embodiment 1 or Embodiment 2, and will not be redundantly described here.

In this embodiment, the display device may include an OLED display device or a liquid crystal display device.

In the display device provided by the present embodiment, the gamma conversion unit is used for performing a gamma conversion process on RGB input signals and generating RGB brightness input values, the brightness detection unit is used for generating a W brightness input value based on RGB proportional coefficients and the RGB brightness input values, and the brightness processing unit is used for generating RGBW output signals based on the RGB proportional coefficients, the RGB brightness input values and the W brightness input value. With the present embodiment, the brightness of a displayed image can be increased with a premise that the power consumption is not changed, so that the contrast of the displayed image is increased, and the display quality of the image is also improved. With the present embodiment, the power consumption of light emitting devices is reduced with a premise that the display brightness of a displayed image is not changed, so that the lifetime of the light emitting devices is increased, the cost of driving chips is reduced and thus the manufacturing cost of products is reduced. Furthermore, with the present embodiment, the manufacturing cost of power supply can be reduced since the power consumption of light emitting devices is reduced, and thus the manufacturing cost of products is reduced. Specially, in a case where the display device is an OLED display device, with the present embodiment, the current flowing through light emitting devices can be effectively reduced, so that the power consumption of light emitting devices can be greatly reduced.

Figure 3:
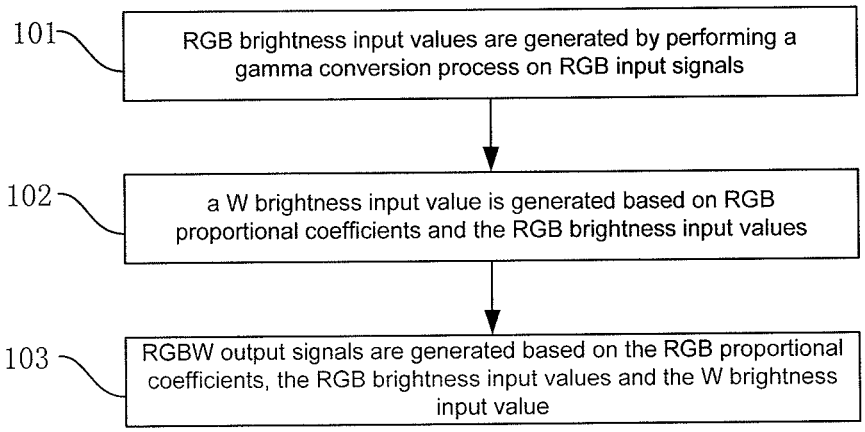
FIG. 3 is a flowchart of a signal conversion method provided by Embodiment 4 of the present invention.

FIG. 3 is a flowchart of a signal conversion method provided by Embodiment 4 of the present invention. As shown in FIG. 3, the method includes the following steps 101 to 103.

Step 101, RGB brightness input values are generated by performing a gamma conversion process on RGB input signals.

Step 102, a W brightness input value is generated based on RGB proportional coefficients and the RGB brightness input values.

Step 103, RGBW output signals are generated based on the RGB proportional coefficients, the RGB brightness input values and the W brightness input value.

For example, the step 103 may include a step of generating RGBW brightness output values based on the RGB proportional coefficients, the RGB brightness input values and the W brightness input value, and a step of generating the RGBW output signals based on the RGBW brightness output values The signal conversion method provided by the present embodiment includes generating the RGB brightness input values by performing the gamma conversion process on the RGB input signals, generating the W brightness input value based on the RGB proportional coefficients and the RGB brightness input values, and generating the RGBW output signals based on the RGB proportional coefficients, the RGB brightness input values and the W brightness input value. With the present embodiment, the brightness of a displayed image can be increased with a premise that the power consumption is not changed, so that the contrast of the displayed image is increased, and the display quality of the image is also improved. With the present embodiment, the power consumption of light emitting devices is reduced with a premise that the display brightness of a displayed image is not changed, so that the lifetime of the light emitting devices is increased, the cost of driving chips is reduced and thus the manufacturing cost of products is reduced. Furthermore, with the present embodiment, the manufacturing cost of power supply can be reduced since the power consumption of light emitting devices is reduced, and thus the manufacturing cost of products is reduced.

Figure 4:
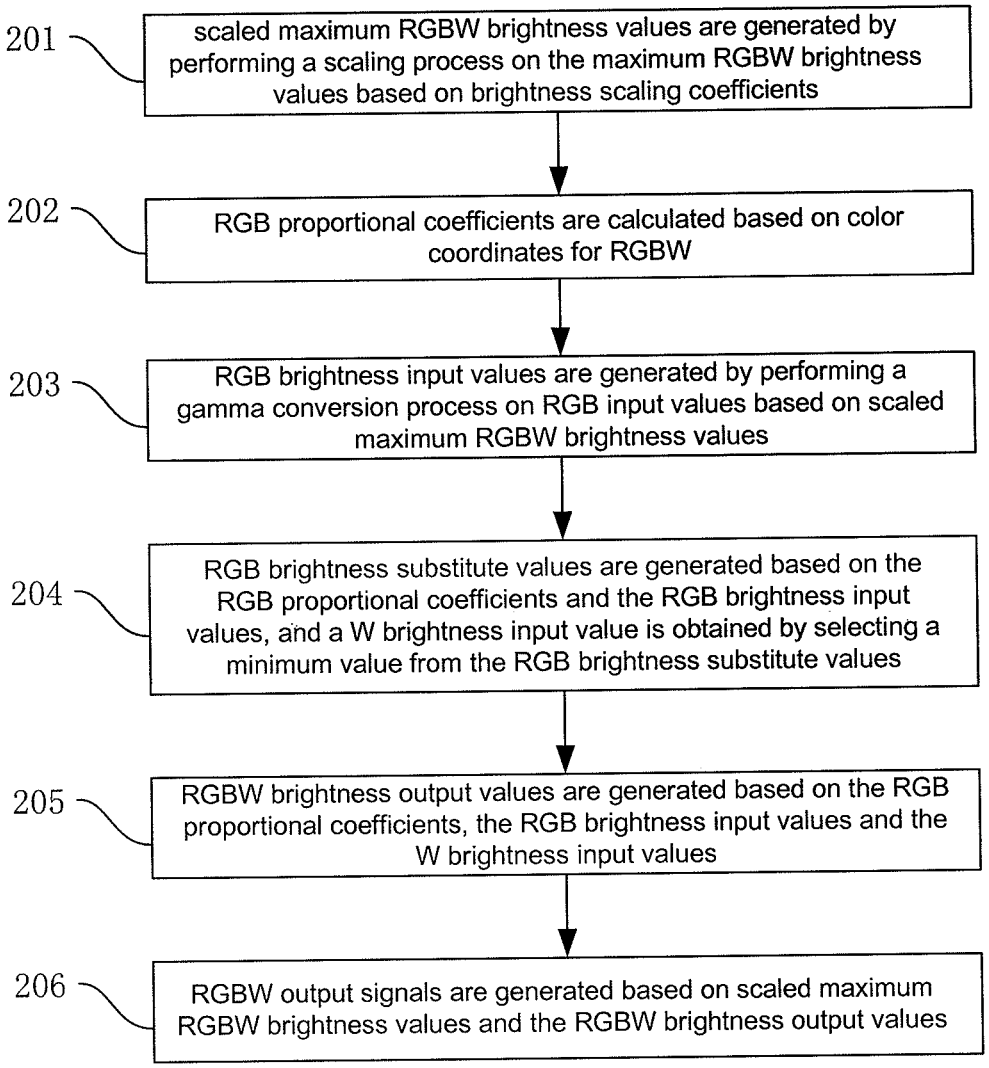
FIG. 4 is a flowchart of a signal conversion method provided by Embodiment 5 of the present invention.

FIG. 4 is flowchart of a signal conversion method provided by Embodiment 5 of the present invention. As shown in FIG. 4, the method includes the following steps of 201 to 206.

Step 201, scaled maximum RGBW brightness values are generated by performing a scaling process on the maximum RGBW brightness values based on brightness scaling coefficients.

Step 202, RGB proportional coefficients are calculated based on color coordinates for RGBW.

Step 203, RGB brightness input values are generated by performing a gamma conversion process on RGB input values based on the scaled maximum RGBW brightness values.

Step 204, RGB brightness substitute values are generated based on the RGB proportional coefficients and the RGB brightness input values, and a W brightness input value is obtained by selecting a minimum value from the RGB brightness substitute values.

Step 205, RGBW brightness output values are generated based on the RGB proportional coefficients, the RGB brightness input values and the W brightness input values.

Step 206, RGBW output signals are generated based on the scaled maximum RGBW brightness values and the RGBW brightness output values.

The signal conversion method provided by the present embodiment can be realized by using the signal conversion device provided by Embodiment 1 and the detailed descriptions of the terms and equations used in the present embodiment can refer to the description of Embodiment 1, and will not be redundantly described here.

The signal conversion method provided by the present embodiment includes generating RGB brightness input values by performing a gamma conversion process on RGB input signals, generating a W brightness input value based on RGB proportional coefficients and the RGB brightness input values, and generating RGBW output signals based on the RGB proportional coefficients, the RGB brightness input values and the W brightness input value. With the present embodiment, the brightness of a displayed image can be increased with a premise that the power consumption is not changed, so that the contrast of the displayed image is increased, and the display quality of the image is also improved. With the present embodiment, the power consumption of light emitting devices is reduced with a premise that the display brightness of a displayed image is not changed, so that the lifetime of the light emitting devices is increased, the cost of driving chips is reduced and thus the manufacturing cost of products is reduced. Furthermore, with the present embodiment, the manufacturing cost of power supply can be reduced since the power consumption of light emitting devices is reduced, and thus the manufacturing cost of products is reduced. In addition, the scaled maximum RGBW brightness values are generated by performing a scaling process on the maximum RGBW brightness values based on the brightness scaling coefficients, so that the brightness of the displayed image can be further improved.

Figure 5:
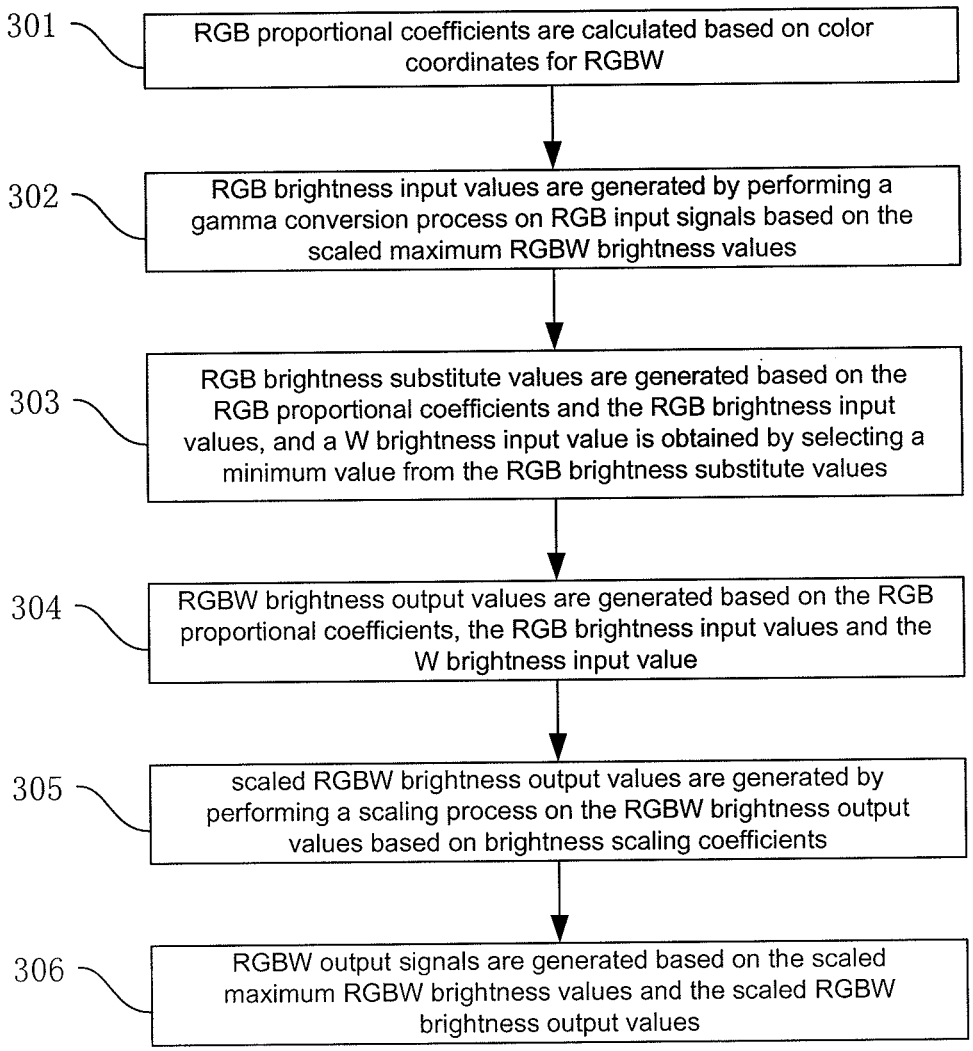
FIG. 5 is a flowchart of a signal conversion method provided by Embodiment 6 of the present invention.

FIG. 5 is a flowchart of a signal conversion method provided by Embodiment 6 of the present invention. As shown in FIG. 5, the method includes the following steps of 301 to 306.

Step 301, RGB proportional coefficients are calculated based on color coordinates for RGBW.

Step 302, RGB brightness input values are generated by performing a gamma conversion process on RGB input signals based on the maximum RGBW brightness values.

Step 303, RGB brightness substitute values are generated based on the RGB proportional coefficients and the RGB brightness input values, and a W brightness input value is obtained by selecting a minimum value from the RGB brightness substitute values.

Step 304, RGBW brightness output values are generated based on the RGB proportional coefficients, the RGB brightness input values and the W brightness input value.

Step 305, scaled RGBW brightness output values are generated by performing a scaling process on the RGBW brightness output values based on brightness scaling coefficients.

Step 306, RGBW output signals are generated based on the maximum RGBW brightness values and the scaled RGBW brightness output values.

The signal conversion method provided by the present embodiment can be realized by using the signal conversion device provided by Embodiment 2 and the detailed descriptions of the terms and equations used in the present embodiment can refer to the description of Embodiment 2, and will not be redundantly described here.

The signal conversion method provided by the present embodiment includes generating RGB brightness input values by performing a gamma conversion process on RGB input signals, generating a W brightness input value based on RGB proportional coefficients and the RGB brightness input values, and generating RGBW output signals based on the RGB proportional coefficients, the RGB brightness input values and the W brightness input value. With the present embodiment, the brightness of a displayed image can be increased with a premise that the power consumption is not changed, so that the contrast of the displayed image is increased, and the display quality of the image is also improved. With the present embodiment, the power consumption of light emitting devices is reduced with a premise that the display brightness of a displayed image is not changed, so that the lifetime of the light emitting devices is increased, the cost of driving chips is reduced and thus the manufacturing cost of products is reduced. Furthermore, with the present embodiment, the manufacturing cost of power supply can be reduced since the power consumption of light emitting devices is reduced, and thus the manufacturing cost of products is reduced. In addition, the scaled RGBW brightness output values are generated by performing a scaling process on the RGBW brightness output values based on the brightness scaling coefficients, so that the brightness of the displayed image can be further improved.

It should be understood that the forgoing embodiments are merely the exemplary embodiments used for illustrating the principle of the present invention, but the present invention is not limited thereto. For those skilled in the art, various modifications and improvements can be made without departing from the spirit and essence of the present invention. Accordingly, these modifications and improvements are deemed to be within the protection scope of the present invention.

What is claimed is:

1. A signal conversion device, including a gamma conversion unit, a brightness detection unit and a brightness processing unit, wherein the gamma conversion unit is used for performing a gamma conversion process on RGB input signals and generating RGB brightness input values;

the brightness detection unit is used for generating a W brightness input value based on RGB proportional coefficients and the RGB brightness input values; and the brightness processing unit is used for generating RGBW output signals based on the RGB proportional coefficients, the RGB brightness input values and the W brightness input value, wherein color coordinates for RGBW include a R color coordinate $R(x_R, y_R)$, a G color coordinate $G(x_G, y_G)$, a B color coordinate $B(x_B, y_B)$ and a W color coordinate $W(x_W, y_W)$; equation for the RGB proportional coefficients is:

proportional coefficient for red $$R_R = \frac{\left(\frac{x_W}{y_W} = \frac{x_B}{y_B}\right)\times\left(\frac{1}{y_G} - \frac{1}{y_B}\right) - \left(\frac{x_G}{y_G} - \frac{x_B}{y_B}\right)\times\left(\frac{1}{y_W} - \frac{1}{y_B}\right)}{\left(\frac{x_R}{y_R} - \frac{x_B}{y_B}\right)\times\left(\frac{1}{y_G} - \frac{1}{y_B}\right) - \left(\frac{x_G}{y_G} - \frac{x_B}{y_B}\right)\times\left(\frac{1}{y_R} - \frac{1}{y_B}\right)},$$

proportional coefficient for green $$R_G = \frac{\left(\frac{x_W}{y_W} - \frac{x_R}{y_R}\right)\times\left(\frac{1}{y_B} - \frac{1}{y_R}\right) - \left(\frac{x_B}{y_B} - \frac{x_R}{y_R}\right)\times\left(\frac{1}{y_W} - \frac{1}{y_R}\right)}{\left(\frac{x_G}{y_G} - \frac{x_R}{y_R}\right)\times\left(\frac{1}{y_B} - \frac{1}{y_R}\right) - \left(\frac{x_B}{y_B} - \frac{x_R}{y_R}\right)\times\left(\frac{1}{y_G} - \frac{1}{y_R}\right)},$$

and proportional coefficient for blue $$R_B = \frac{\left(\frac{x_W}{y_W} - \frac{x_G}{y_G}\right)\times\left(\frac{1}{y_R} - \frac{1}{y_G}\right) - \left(\frac{x_R}{y_R} - \frac{x_G}{y_G}\right)\times\left(\frac{1}{y_W} - \frac{1}{y_G}\right)}{\left(\frac{x_B}{y_B} - \frac{x_G}{y_G}\right)\times\left(\frac{1}{y_R} - \frac{1}{y_G}\right) - \left(\frac{x_R}{y_R} - \frac{x_G}{y_G}\right)\times\left(\frac{1}{y_B} - \frac{1}{y_G}\right)};$$

or proportional coefficient for red $$R_R = \frac{\left(\frac{x_W}{y_W} - \frac{x_G}{y_G}\right)\times\left(\frac{1}{y_B} - \frac{1}{y_G}\right) - \left(\frac{x_B}{y_B} - \frac{x_G}{y_G}\right)\times\left(\frac{1}{y_W} - \frac{1}{y_G}\right)}{\left(\frac{x_R}{y_R} - \frac{x_G}{y_G}\right)\times\left(\frac{1}{y_B} - \frac{1}{y_G}\right) - \left(\frac{x_B}{y_B} - \frac{x_G}{y_G}\right)\times\left(\frac{1}{y_R} - \frac{1}{y_G}\right)},$$

proportional coefficient for green $$R_G = \frac{\left(\frac{x_W}{y_W} - \frac{x_B}{y_B}\right)\times\left(\frac{1}{y_R} - \frac{1}{y_B}\right) - \left(\frac{x_R}{y_R} - \frac{x_B}{y_B}\right)\times\left(\frac{1}{y_W} - \frac{1}{y_B}\right)}{\left(\frac{x_G}{y_G} - \frac{x_B}{y_B}\right)\times\left(\frac{1}{y_R} - \frac{1}{y_B}\right) - \left(\frac{x_R}{y_R} - \frac{x_B}{y_B}\right)\times\left(\frac{1}{y_G} - \frac{1}{y_B}\right)},$$

and proportional coefficient for blue $$R_B = \frac{\left(\frac{x_W}{y_W} - \frac{x_R}{y_R}\right)\times\left(\frac{1}{y_G} - \frac{1}{y_R}\right) - \left(\frac{x_G}{y_G} - \frac{x_R}{y_R}\right)\times\left(\frac{1}{y_W} - \frac{1}{y_R}\right)}{\left(\frac{x_B}{y_B} - \frac{x_R}{y_R}\right)\times\left(\frac{1}{y_G} - \frac{1}{y_R}\right) - \left(\frac{x_G}{y_G} - \frac{x_R}{y_R}\right)\times\left(\frac{1}{y_B} - \frac{1}{y_R}\right)}.$$

2. The signal conversion device according to claim 1, wherein the brightness processing unit includes a brightness calculation unit and a reverse gamma conversion unit, wherein the brightness calculation unit generates RGBW brightness output values based on the RGB proportional coefficients, the RGB brightness input values and the W brightness input value, and outputs the RGBW brightness output values to the reverse gamma conversion unit; and the reverse gamma conversion unit generates the RGBW output signals based on the RGBW brightness output values.

3. The signal conversion device according to claim 2, the brightness processing unit further includes a brightness scaling unit for performing a scaling process on a maximum RGBW brightness values based on brightness scaling coefficients, generating a scaled maximum RGBW brightness values, and outputting the scaled maximum RGBW brightness values to the gamma conversion unit and the reverse gamma conversion unit, wherein the gamma conversion unit performs the gamma conversion process on the RGB input signals based on the scaled maximum RGBW brightness values, generates the RGB brightness input values, and outputs the RGB brightness input values to the brightness detection unit and the brightness calculation unit; and the reverse gamma conversion unit generates the RGBW output signals based on the scaled maximum RGBW brightness values and the RGBW brightness output values.

4. The signal conversion device according to claim 3, wherein the scaled maximum RGBW brightness values include a scaled maximum R brightness value $L_{R\ max}$, a scaled maximum G brightness value $L_{G\ max}$, a scaled maximum B brightness value $L_{B\ max}$, and a scaled maximum W brightness value $L_{W\ max}$; the RGB input signals include a R input signal Ri, a G input signal Gi and a B input signal Bi; the RGB brightness input values include a R brightness input value $L_R$, a G brightness input value $L_G$ and a B brightness input value $L_B$; and equations for the RGBW brightness input values are:

$$L_R = L_{Rmax} \times \left(\frac{Ri}{2^n}\right)^{\gamma},\ L_G = L_{Gmax} \times \left(\frac{Gi}{2^n}\right)^{\gamma} \text{ and } L_B = L_{Bmax} \times \left(\frac{Bi}{2^n}\right)^{\gamma},$$

where n is the number of bits of the RGB input signals and γ is a gamma value.

5. The signal conversion device according to claim 4, wherein the RGBW brightness output values include a R brightness output value $L_{R'}$, a G brightness output value $L_{G'}$, a B brightness output value $L_{B'}$, and a W brightness output value $L_{W'}$, the RGB proportional coefficients include a R proportional coefficient $R_R$, a G proportional coefficient $R_G$ and a B proportional coefficient $R_B$; the RGBW brightness output values are $L_{R'}=L_R-L_W \times R_R$, $L_{G'}=L_G-L_W \times R_G$, $L_{B'}=L_B-L_W \times R_B$, $L_{W'}=L_W$, respectively, where $L_W$ is the W brightness input value.

6. The signal conversion device according to claim 5, wherein the RGBW output signals include a R output signal Ro, a G output signal Go, a B output signal Bo and a W output signal Wo;

the RGBW output signals are $$Ro = \left(\frac{L_{R'}}{L_{Rmax}}\right)^{\frac{1}{\gamma}} \times 2^n,\ Go = \left(\frac{L_{G'}}{L_{Gmax}}\right)^{\frac{1}{\gamma}} \times 2^n,\ Bo = \left(\frac{L_{B'}}{L_{Bmax}}\right)^{\frac{1}{\gamma}} \times 2^n \text{ and}$$

$$Wo = \left(\frac{L_{W'}}{L_{Wmax}}\right)^{\frac{1}{\gamma}} \times 2^n,$$

respectively.

7. The signal conversion device according to claim 6, wherein the brightness scaling coefficient of the brightness scaling unit is K, the maximum R brightness value is $L_{R'max}$ the maximum G brightness value is $L_{G'max}$, the maximum B brightness value is $L_{B'max}$ and the maximum W brightness value is $L_{W'max}$, wherein $L_{R\,max}=K \times L_{R'max}$, $L_{G\,max}=K \times L_{G'max}$, $L_{B\,max}=K \times L_{B'max}$ and $L_{W\,max}=K \times L_{W'max}$, so that $$Ro = \left(\frac{L_{R'}}{K \times L_{R'max}}\right)^{\frac{1}{\gamma}} \times 2^n,\ Go = \left(\frac{L_{G'}}{K \times L_{G'max}}\right)^{\frac{1}{\gamma}} \times 2^n,$$

$$Bo = \left(\frac{L_{B'}}{K \times L_{B'max}}\right)^{\frac{1}{\gamma}} \times 2^n \text{ and } Wo = \left(\frac{L_{W'}}{K \times L_{W'max}}\right)^{\frac{1}{\gamma}} \times 2^n.$$

8. The signal conversion device according to claim 5, further including a RGB proportion calculation unit, wherein the RGB proportion calculation unit is used for calculating the RGB proportional coefficients based on color coordinates for RGBW.

9. The signal conversion device according to claim 1, wherein the brightness detection unit generates RGB brightness substitute values based on the RGB proportional coefficients and the RGB brightness input values, and selects a minimum value from the RGB brightness substitute values as the W brightness input value.

10. The signal conversion device according to claim 9, wherein the RGB brightness substitute values include a R brightness substitute value $S_R$, a G brightness substitute value $S_G$ and a B brightness substitute value $S_B$, the RGB brightness substitute values are $$S_R = \frac{L_R}{R_R},\ S_G = \frac{L_G}{R_G} \text{ and } S_B = \frac{L_B}{R_B},$$

respectively; and equation for the W brightness input value is $L_W=\text{MIN}(S_R, S_G, S_B)$.

11. The signal conversion unit according to claim 1, wherein the brightness processing unit includes a brightness calculation unit, a brightness scaling unit and a reverse gamma conversion unit, wherein the gamma conversion unit performs the gamma conversion process on the RGB input signals based on a maximum RGBW brightness values, generates RGB brightness input values, and outputs the RGB brightness input values to the brightness detection unit and the brightness calculation unit;

the brightness calculation unit generates RGBW brightness output values based on the RGB proportional coefficients, the RGB brightness input values and the W brightness input value, and outputs the RGBW brightness output values to the brightness scaling unit;

the brightness scaling unit performs a scaling process on the RGBW brightness output values based on brightness scaling coefficients, generates scaled RGBW brightness output values, and outputs the scaled RGBW brightness output values to the reverse gamma conversion unit, and the reverse gamma conversion unit generates the RGBW output signals based on the maximum RGBW brightness values and the scaled RGBW brightness output values.

12. The signal conversion device according to claim 11, wherein the RGB input signals include a R input signal Ri, a G input signal Gi and a B input signal Bi, and the RGB brightness input values include a R brightness input value $L_R$, a G brightness input value $L_G$ and a B brightness input value $L_B$; equations for the RGB brightness input values are $$L_R = L_{R'max} \times \left(\frac{Ri}{2^n}\right)^{\gamma},\ L_G = L_{G'max} \times \left(\frac{Gi}{2^n}\right)^{\gamma} \text{ and } L_B = L_{B'max} \times \left(\frac{Bi}{2^n}\right)^{\gamma},$$

where n is the number of bits of the RGB input signals, γ is a gamma value, $L_{R'max}$ is the maximum R brightness value, $L_{G'max}$ is the maximum G brightness value and $L_{B'max}$ is the maximum B brightness value.

13. The signal conversion device according to claim 12, wherein the RGBW brightness output values include a R brightness output value $L_{R'}$, a G brightness output value $L_{G'}$, a B brightness output value $L_{B'}$, and a W brightness output value $L_{W'}$, the RGB proportional coefficients include a R proportional coefficient $R_R$, a G proportional coefficient $R_G$ and a B proportional coefficient $R_B$; the RGBW brightness output values are $L_{R'}=L_R-L_W\times R_R$, $L_{G'}=L_G-L_B\times R_G$, $L_{B'}=L_B-L_W\times R_B$, $L_{W'}=L_W$, respectively, where $L_W$ is the W brightness input value.

14. The signal conversion device according to claim 13, wherein the RGBW output signals include a R output signal Ro, a G output signal Go, a B output signal Bo and a W output signal Wo;

the RGBW output signals are $$Ro=\left(\frac{L_{R1}}{L_{R'max}}\right)^{\frac{1}{\gamma}}\times 2^n,\ Go=\left(\frac{L_{G1}}{L_{G'max}}\right)^{\frac{1}{\gamma}}\times 2^n,\ Bo=\left(\frac{L_{B1}}{L_{B'max}}\right)^{\frac{1}{\gamma}}\times 2^n \text{ and}$$

$$Wo=\left(\frac{L_{W1}}{L_{W'max}}\right)^{\frac{1}{\gamma}}\times 2^n,$$

respectively, $L_{W'\,max}$ where is the maximum W brightness value, $L_{R1}$ is a scaled R brightness output value, $L_{G1}$ is a scaled G brightness output value, $L_{B1}$ is a scaled B brightness output value and $L_{W1}$ is a scaled W brightness output value.

15. The signal conversion device according to claim 14, wherein the brightness scaling coefficient of the brightness scaling unit is 1/K, and $$L_{R1}=\frac{L_{R'}}{K'},\ L_{G1}=\frac{L_{G'}}{K'},\ L_{B1}=\frac{L_{B'}}{K} \text{ and } L_{W1}=\frac{L_{W'}}{K},$$

the RGBW output signals are $$Ro=\left(\frac{L_{R'}}{K\times L_{R'max}}\right)^{\frac{1}{\gamma}}\times 2^n,\ Go=\left(\frac{L_{G'}}{K\times L_{G'max}}\right)^{\frac{1}{\gamma}}\times 2^n,$$

$$Bo=\left(\frac{L_{B'}}{K\times L_{B'max}}\right)^{\frac{1}{\gamma}}\times 2^n \text{ and } Wo=\left(\frac{L_{W'}}{K\times L_{W'max}}\right)^{\frac{1}{\gamma}}\times 2^n,$$

respectively.

16. A display device, including the signal conversion device according to claim 1.

17. A signal conversion method, including the following steps of step S1, generating RGB brightness input values by performing a gamma conversion process on RGB input signals;

step S2, generating a W brightness input value based on RGB proportional coefficients and the RGB brightness input values; and step S3, generating RGBW output signals based on the RGB proportional coefficients, the RGB brightness input values and the W brightness input value, wherein color coordinates for RGBW include a R color coordinate $R(x_R, y_R)$, a G color coordinate $G(x_G, y_G)$, a B color coordinate $B(x_B, y_B)$ and a W color coordinate $W(x_W, y_W)$; equation for the RGB proportional coefficients is:

proportional coefficient for red $$R_R=\frac{\left(\frac{x_W}{y_W}=\frac{x_B}{y_B}\right)\times\left(\frac{1}{y_G}-\frac{1}{y_B}\right)-\left(\frac{x_G}{y_G}-\frac{x_B}{y_B}\right)\times\left(\frac{1}{y_W}-\frac{1}{y_B}\right)}{\left(\frac{x_R}{y_R}-\frac{x_B}{y_B}\right)\times\left(\frac{1}{y_G}-\frac{1}{y_B}\right)-\left(\frac{x_G}{y_G}-\frac{x_B}{y_B}\right)\times\left(\frac{1}{y_R}-\frac{1}{y_B}\right)},$$

proportional coefficient for green $$R_G=\frac{\left(\frac{x_W}{y_W}-\frac{x_R}{y_R}\right)\times\left(\frac{1}{y_B}-\frac{1}{y_R}\right)-\left(\frac{x_B}{y_B}-\frac{x_R}{y_R}\right)\times\left(\frac{1}{y_W}-\frac{1}{y_R}\right)}{\left(\frac{x_G}{y_G}-\frac{x_R}{y_R}\right)\times\left(\frac{1}{y_B}-\frac{1}{y_R}\right)-\left(\frac{x_B}{y_B}-\frac{x_R}{y_R}\right)\times\left(\frac{1}{y_G}-\frac{1}{y_R}\right)},$$

proportional coefficient for blue $$R_B=\frac{\left(\frac{x_W}{y_W}-\frac{x_G}{y_G}\right)\times\left(\frac{1}{y_R}-\frac{1}{y_G}\right)-\left(\frac{x_R}{y_R}-\frac{x_G}{y_G}\right)\times\left(\frac{1}{y_W}-\frac{1}{y_G}\right)}{\left(\frac{x_B}{y_B}-\frac{x_G}{y_G}\right)\times\left(\frac{1}{y_R}-\frac{1}{y_G}\right)-\left(\frac{x_R}{y_R}-\frac{x_G}{y_G}\right)\times\left(\frac{1}{y_B}-\frac{1}{y_G}\right)};$$

proportional coefficient for red $$R_R=\frac{\left(\frac{x_W}{y_W}-\frac{x_G}{y_G}\right)\times\left(\frac{1}{y_B}-\frac{1}{y_G}\right)-\left(\frac{x_B}{y_B}-\frac{x_G}{y_G}\right)\times\left(\frac{1}{y_W}-\frac{1}{y_G}\right)}{\left(\frac{x_R}{y_R}-\frac{x_G}{y_G}\right)\times\left(\frac{1}{y_B}-\frac{1}{y_G}\right)-\left(\frac{x_B}{y_B}-\frac{x_G}{y_G}\right)\times\left(\frac{1}{y_R}-\frac{1}{y_G}\right)},$$

proportional coefficient for green $$R_G=\frac{\left(\frac{x_W}{y_W}-\frac{x_B}{y_B}\right)\times\left(\frac{1}{y_R}-\frac{1}{y_B}\right)-\left(\frac{x_R}{y_R}-\frac{x_B}{y_B}\right)\times\left(\frac{1}{y_W}-\frac{1}{y_B}\right)}{\left(\frac{x_G}{y_G}-\frac{x_B}{y_B}\right)\times\left(\frac{1}{y_R}-\frac{1}{y_B}\right)-\left(\frac{x_R}{y_R}-\frac{x_B}{y_B}\right)\times\left(\frac{1}{y_G}-\frac{1}{y_B}\right)},$$

proportional coefficient for blue $$R_B=\frac{\left(\frac{x_W}{y_W}-\frac{x_R}{y_R}\right)\times\left(\frac{1}{y_G}-\frac{1}{y_R}\right)-\left(\frac{x_G}{y_G}-\frac{x_R}{y_R}\right)\times\left(\frac{1}{y_W}-\frac{1}{y_R}\right)}{\left(\frac{x_B}{y_B}-\frac{x_R}{y_R}\right)\times\left(\frac{1}{y_G}-\frac{1}{y_R}\right)-\left(\frac{x_G}{y_G}-\frac{x_R}{y_R}\right)\times\left(\frac{1}{y_B}-\frac{1}{y_R}\right)}.$$

18. The signal conversion method according to claim 17, wherein the step S3 including the following steps of generating RGBW brightness output values based on the RGB proportional coefficients, the RGB brightness input values and the W brightness input value; and generating the RGBW output signals based on the RGBW brightness output values.

19. The signal conversion method according to claim 18, wherein the step S1 further includes generating scaled maximum RGBW brightness values by performing a scaling process on maximum RGBW brightness values based on brightness scaling coefficients, and generating RGB brightness input values by performing a gamma conversion process on the RGB input signals based the scaled maximum RGBW brightness values, and the step S3 further includes generating the RGBW output signals based on the scaled maximum RGBW brightness values and the RGBW brightness output values.

20. The signal conversion method according to claim 17, wherein the step S1 further includes generating the RGB brightness input values by performing a gamma conversion process on the RGB input signals based on the maximum RGBW brightness values, and the step S3 further includes generating scaled RGBW brightness output values by performing a scaling process on the RGBW brightness output values based on the brightness scaling coefficients; and generating the RGBW output signals based on the maximum RGBW brightness values and the scaled RGBW brightness output values.

21. The signal conversion method according to claim 17, wherein the RGB proportional coefficients are calculated based on color coordinates for RGBW.

22. The signal conversion method according to claim 17, wherein the step S2 further includes generating RGB brightness substitute values based on the RGB proportional coefficients and the RGB brightness input values and obtaining the W brightness input value by selecting a minimum value from the RGB brightness substitute values.

* * * * *